United States Patent [19]

Tietz

[11] 4,325,242

[45] Apr. 20, 1982

[54] MULTI-LEVEL LOCK SYSTEM AND METHOD

[75] Inventor: Werner Tietz, Berlin, Fed. Rep. of Germany

[73] Assignee: ZEISS IKON AG Goerzwerk, Berlin, Fed. Rep. of Germany

[21] Appl. No.: 131,810

[22] Filed: Mar. 19, 1980

Related U.S. Application Data

[63] Continuation-in-part of Ser. No. 940,787, Sep. 8, 1978, Pat. No. 4,221,121.

[30] Foreign Application Priority Data

Aug. 25, 1977 [DE] Fed. Rep. of Germany ..... 2738313

[51] Int. Cl.[3] ..... E05B 19/02

[52] U.S. Cl. ..... 70/401; 70/358; 70/407; 70/409

[58] Field of Search ..... 70/358, 364 A, 401, 70/406, 407, 409, 411

[56] References Cited

U.S. PATENT DOCUMENTS

| | | | |
|---|---|---|---|
| 3,777,520 | 12/1973 | Crepinsek | 70/358 |
| 4,116,025 | 9/1978 | Wolter | 70/358 |
| 4,213,316 | 7/1980 | Tietz | 70/358 |

FOREIGN PATENT DOCUMENTS

| | | | |
|---|---|---|---|
| 2413520 | 8/1979 | France | 70/409 |

*Primary Examiner*—Robert L. Wolfe

*Attorney, Agent, or Firm*—Hill, Van Santen, Steadman, Chiara & Simpson

[57] ABSTRACT

A key for use in a hierarchal lock system with an elongated body and selectively spaced notches cut on an elongated edge of the body. Two rows of discontinuous rib members are attached to each side of the elongated body of the key.

9 Claims, 5 Drawing Figures

MULTI-LEVEL LOCK SYSTEM AND METHOD

CROSS-REFERENCE TO RELATED APPLICATION

This application is a continuation-in-part of my previously allowed U.S. Patent application, Ser. No. 940,787, filed Sept. 8, 1978 and now U.S. Pat. No. 4,221,121. That application in its entirety is hereby incorporated by reference herein.

BACKGROUND OF THE INVENTION

1. Field of the Invention

The invention pertains to lock systems with multiple levels of keys.

2. The Prior Art

The subject matter of the parent patent application is a lock system consisting of cylinder locks and appertaining flat keys in which laterally oriented blocking elements are positioned in laterally oriented bores of the rotary cylinder. Said blocking elements sense the profile thickness of an inserted key and, given a predetermined profile thickness, are forced far enough outwardly that their outer ends are level with the perimeter of the cylinder. If the inserted key has a reduced or non-existent profile, an unfilled space is left at the end of the bore. After an initial rotation of the cylinder, a housing pin can fall into the unfilled end of a lateral bore and block further rotation of the cylinder. The fundamental inventive idea therein is that a higher order key exhibits a flat coordination notch at the sensing location of the blocking elements and also exhibits at least one rib at the area of the flat side adjacent thereto. The rib extends laterally from the profile of the key. The rib or ribs are adapted to displace the blocking elements into the position in which they release the cylinder. Further, a lower order key is provided at the same sensing location of the blocking elements with a deep coordination notch, whereby there are no rib or ribs extending laterally from the profile of the key. The core pin allocated to said coordination notch has an upper offset piece and an appertaining shank whose diameter corresponds to the thickness of the lateral ribs of the higher order key at the sensing location, whereby this shank, just like the ribs, is adapted to displace the blocking elements into the position which releases the cylinder.

A significant feature of the subject matter of the invention of the parent patent application consists therein that the blocking elements are formed of blocking pins which exhibit offset sensing ends whose thickness corresponds to the length of the offset core pin piece in addition to its point, and that the diameter of the pin shanks corresponds to that of the allocated housing pin.

A lock system is achieved by means of the invention of the parent patent application in which the higher order keys are largely secured against copying. In order to make such a higher order key from a lower order key, in contrast to standard copying methods based on removal of material, material would have to be applied in order to fill the deep notch of the lower order key in the direction of a flat notch and the formation of one or more lateral profile ribs.

Protection against copying flat keys provided with profile is already the subject matter of the German LP No. 2,059,523 whose main inventive idea is to be viewed therein that at least one additional longitudinal rib projecting beyond the lateral surface of the flat key is provided, by means of which additional longitudinal rib an additional locking blocking pin is actuated. The lock can be actuated when the additional longitudinal rib exhibits a predetermined height which displaces the additional blocking pin far enough toward the outside of the cylinder that it completely fills its cylinder core bore in addition to a preceding counter-sink which may be present. The blocking pin so displaced does not allow the allocated housing pin to spring into the bearing bore of the blocking pin or, respectively, the counter-sink after an initial rotation of the cylinder core and prevent further rotation of the cylinder core.

According to a further feature of the lock device of the German LP No. 2,059,523, two additional longitudinal ribs are provided which project from the opposite lateral faces of the flat key and are each sensed by an additional blocking pin.

As in the subject matter of the parent patent application, the advantage connected with this key is that the key is protected against copying since its manufacture from commercially available blanks requires the addition of material in order to be able to form the additional longitudinal ribs projecting over the key profile. This feature, as already explained, represents a departure from the usual copying method by means of removal of material and which is very difficult for an unauthorized copier.

In order to make the lock device of the German LP No. 2,059,523 tamper-proof by preventing the additional blocking pins, which sense the additional longitudinal ribs from being rendered ineffective by means of manipulation, a lock device consisting of a rotary cylinder lock and an appertaining flat key has been proposed by the German LP No. 2,441,362. The lock of the German '362 patent proceeded from the fact that additional one-piece blocking pins can be arranged in the cylinder core of the lock and at least one additional longitudinal rib projecting laterally from the surface of the flat key is provided at the lateral face of the flat key. The additional longitudinal rib is sensed by the additional blocking pins. These pins, given a flat key which fits, lie in the separating line between the cylinder core and the cylinder housing with its end face facing away from the key channel and allow the continued rotation of the cylinder core after an initial rotation. The primary inventive idea in this case consists of the use of safety blocking pins arranged in front of, as viewed from the key bit, the additional blocking pins. These safety blocking pins sense the recesses of the additional longitudinal ribs and which are opposite the locking recesses, grooves or the like in the cylinder housing. It is these locking recesses, grooves or the like that the safety blocking pins enter when they assume their blocking position.

The resistance to tampering achieved with this lock device is first based on the fact that the safety pins seated in front of the additional blocking pins no longer allow displacement of the additional blocking pins toward the outside of the cylinder by means of a tool. Further, it is based on the fact that every positional displacement of the safety pins toward the outside by means of a tool or the like effects entry of these pins into their housing bores which results in the immediate blocking of the cylinder core against rotation.

The above inventions reveal ways of making keys nonduplicatable and making the locks functioning with them tamper-proof. In the subject matter of the parent patent application as well as in that of the German LP No. 2,059,523, the protection against duplication of keys is achieved in that an addition of material is required in order to duplicate the keys. In the subject matter of the German LP No. 2,411,362, the lock's resistance to tampering is achieved in that safety blocking pins are connected in front of the blocking pins sensing the additional longitudinal rib of the key, whereby the additional longitudinal rib consists of a sequence of elevations and depressions, i.e., is modulated as to height.

SUMMARY OF THE INVENTION

The object of the present invention is to create a lock suitable for the construction of a lock system. The lock very inexpensively is to ensure an increase of the combination of keying possibilities as well as a very significant increase in its resistance to tampering.

In our parent patent application, the higher order key exhibits a flat coordination notch at the sensing location of the blocking elements as well as rib rising above the profile of the key at the lateral side area adjacent thereto. That rib, given a predetermined height, forces the blocking elements into their release position. The lower order keys are provided with a deeper coordination notch at the same sensing location such that the rib rising above the profile is lacking. The core pin allocated to the coordination notches exhibits an upper offset piece of smaller diameter and an appertaining, thicker shank whose diameter equals the thickness of the lateral ribs of the higher order key at the sensing location. This shank, just like said ribs, is adapted to force the blocking elements into the cylinder release position.

In combination with a lock of the type shown in our parent application, in the present invention at least two additional discontinuous longitudinal ribs are provided on at least one lateral side of the key. These additional longitudinal ribs cooperate with blocking elements in front of which, as viewed from the key bit, or adjacent to which safety pins are connected which sense the adjacent recesses or interruptions in the additional discontinuous profile ribs.

In the present invention, the higher order keys are equipped with a greater plurality of profile ribs than the lower order keys and the main or master key is equipped with the greatest possible plurality of profile ribs.

DETAILED DESCRIPTION OF THE PREFERRED EMBODIMENTS

Not by way of limitation but by way of disclosing the best mode of practicing our invention and by way of enabling one of skill in the art to practice our invention, FIGS. 1 to 5 disclose one embodiment of our invention.

Figure 1:
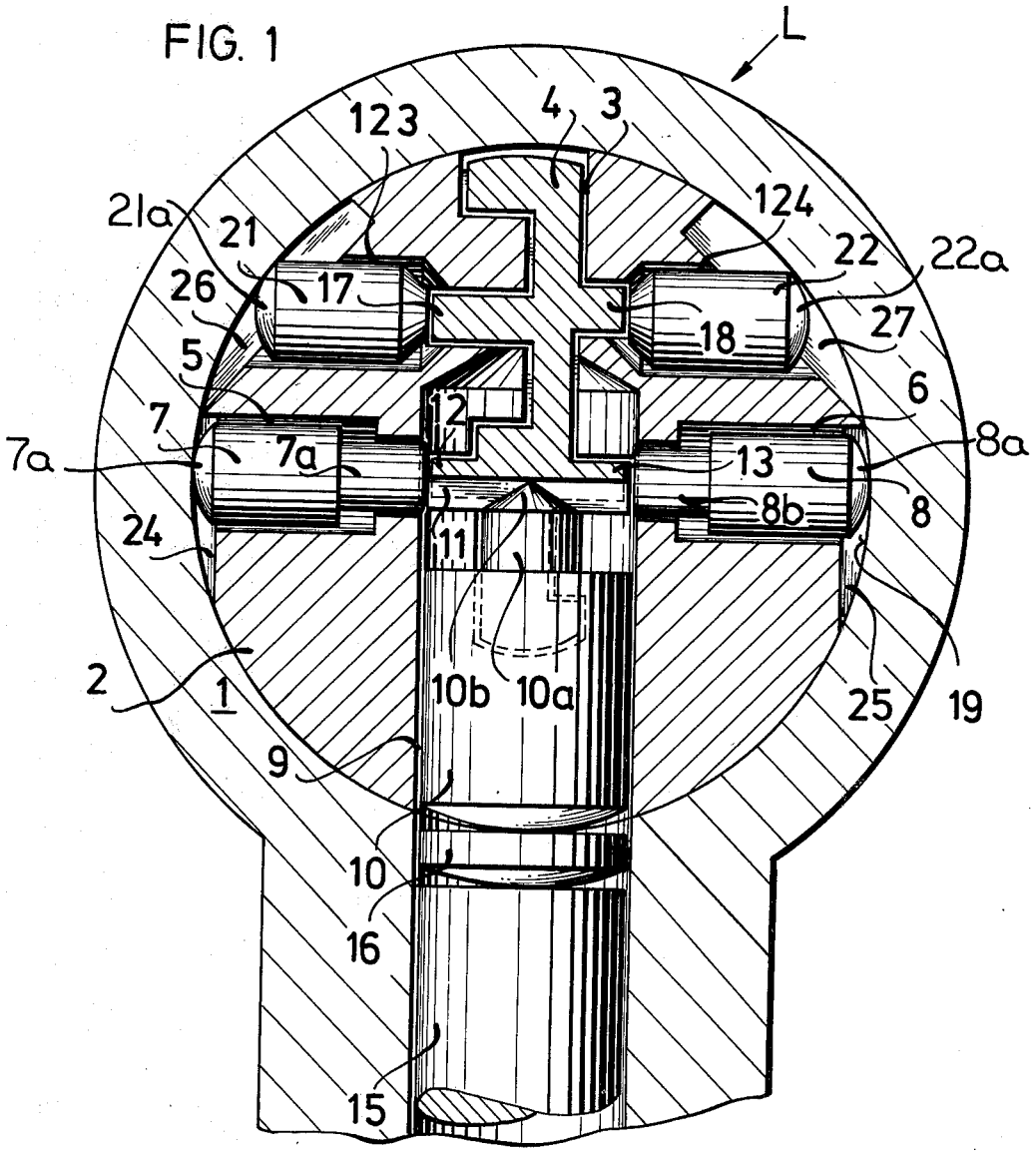
FIG. 1 is a sectional planar view taken essentially perpendicular through a cylinder lock, incorporating principles of the present invention, adjacent a selected cylinder pin with a higher order key inserted therein.

FIG. 1 indicates a lock L with a housing 1 and a cylinder 2. The lock L has a key channel 3 into which a master key 4 is introduced. The key 4 exhibits a profile with profile grooves preferably designed rectangularly and profile ribs 12, 13 and 17, 18 on each lateral side. The profile ribs 12, 13, 17, 18 are sensed by means of blocking pins or elements 7, 8 and 21, 22. The pins 7, 8, 21 and 22 are seated in cylinder core bores 5, 6 and 123, 124 which terminate in counter-sinks 24, 25 and 26, 27 into which a housing pin 15 can drop after a short cylinder core rotation when the countersinks 24, 25 are not filled out by end regions *7a*, *8a*, *21a* and *22a* of the blocking pins 7, 8, 21 and 22. The blocking pins 7, 8 each have a sensing end *7b*, *8b*. Each sensing end *7b*, *8b* has a smaller diameter than the remainder of the pin 7, 8.

The core pin 10 located in a cylinder boring 9 can cooperate with a coordination notch 11 in the main or master key 4 at the sensing location of the blocking pins 7, 8. The pin 10 has an upper contracted neck section *10a* with a tip *10b* which is adapted to drop into the coordinating notch 11 made available to it.

The profile ribs 12, 13 and 17, 18 project laterally from the key profile and are adapted to force the blocking pins 7, 8 and 21, 22 toward the outer surface 19 of the cylinder 2 such that the outer ends *7a*, *8a*, *21a* and *22a* of said blocking pins essentially coincide with the cylinder perimeter 19. Thus, the appertaining housing pin 15 is prevented from dropping into one of the counter-sinks 24 through 27 after the initial rotation of the cylinder core 2.

A disk 16 is located between the core pin 10 and the housing pin 15. The function of the disk 16 shall be described in greater detail in conjunction with FIG. 2.

Figure 2:
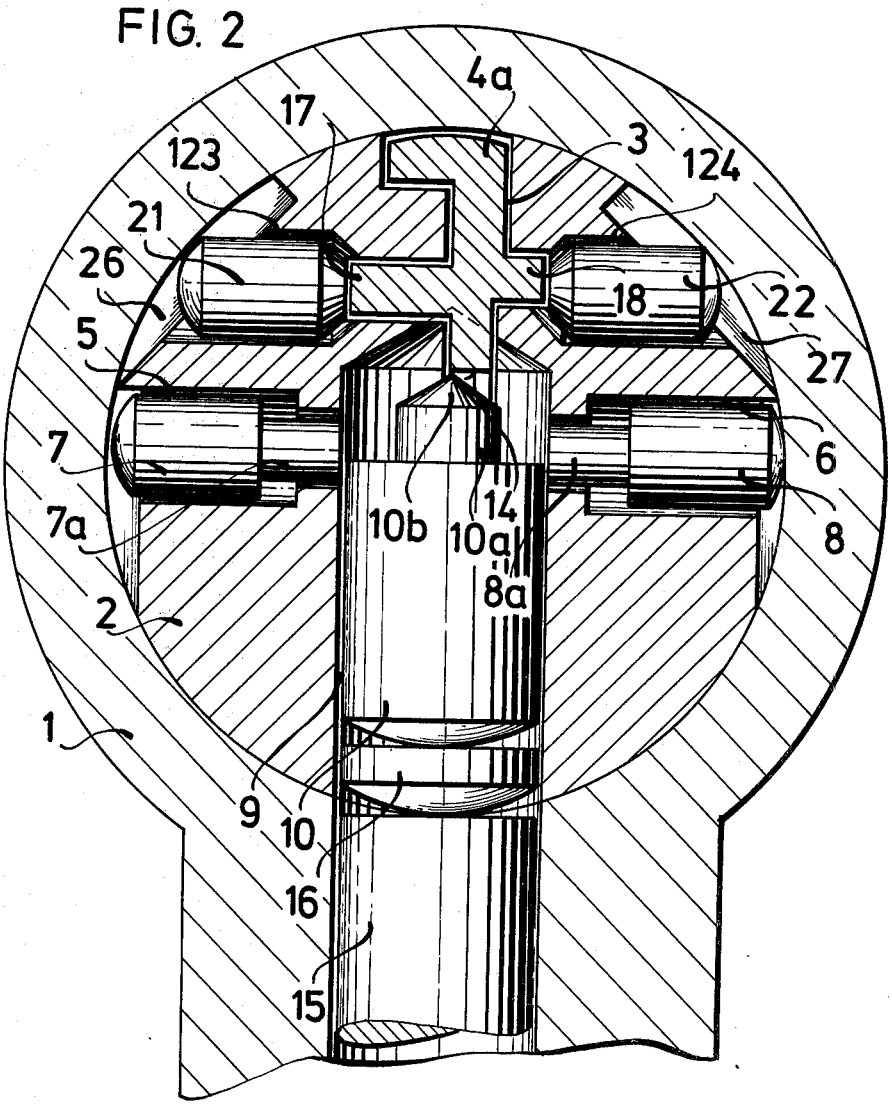
FIG. 2 is a sectional planar view taken essentially perpendicular through a cylinder lock, incorporating principles of the present invention, adjacent a selected cylinder pin with a lower order key inserted therein.

In FIG. 2, the lock of FIG. 1 is shown with a lower order key *4a* introduced into the lock channel 3. The lower order key *4a* has a deep coordination notch 14 at the sensing location of the blocking pins 7, 8. The coordination notch 14 causes the core pin 10 to rise significantly higher than was the case with the flat notch 11 of the higher order key 4 of FIG. 1. The core pin 10 is driven by a compression spring not shown here which forces the housing pin 15 inwardly toward the cylinder 2.

Due to the higher movement of the pin combination 10, 16, 15, into the bore 9, the larger diameter section of the core pin 10 moves adjacent the sensing ends *7a*, *8a* of the blocking pins 7, 8. The profile ribs 12, 13 of the higher order key 4 are omitted at this location because of the deep coordination notch 14 of the lower order key *4a*. The function which the profile ribs 12, 13 had on the key 4 to force the blocking pins 7, 8 outwardly is assumed by the shank of the core pin 10 which has been lifted up. Since this shank exhibits a diameter corresponding to the thickness of the profile ribs, it causes the blocking pins 7, 8 to be displaced toward the outside perimeter 19 and into their alignment position.

A lock system constructed with locks and keys of the type described above has the advantage that the keys are largely secured against duplication. The proper addition of material at the location of the deep coordination notch 14 on a lower order key 4a in order to produce the higher order key 4 of FIG. 1 is difficult.

Figure 3:
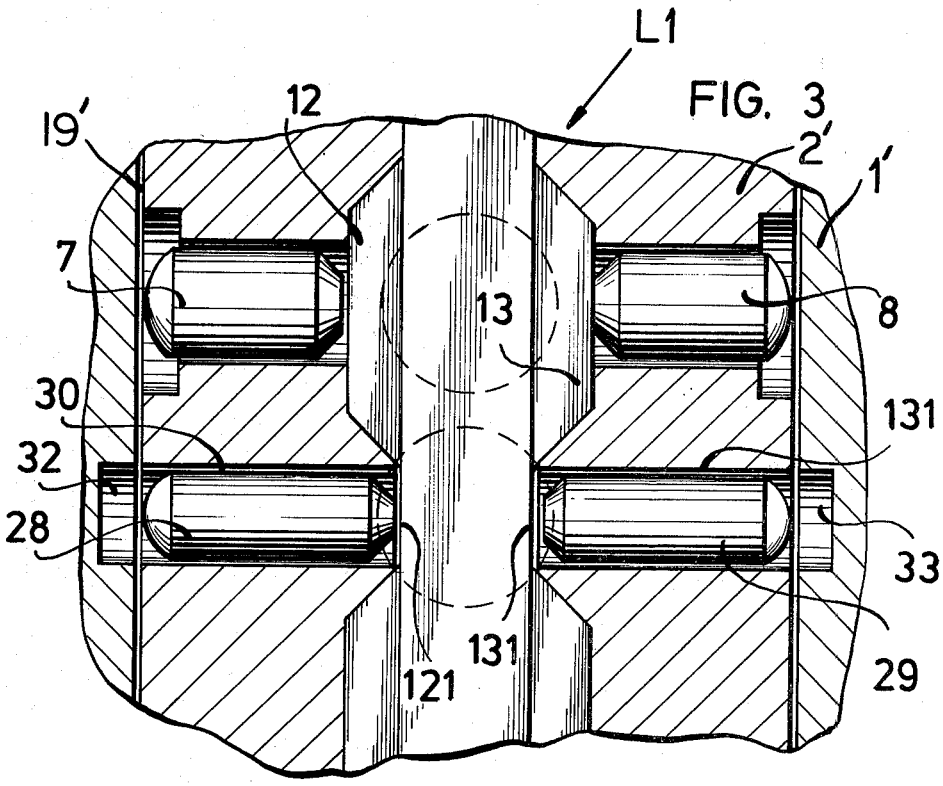
FIG. 3 is a top, fragmentary planar view showing the location of a pair of blocking pins and a pair of safety pins in the unlocked condition.

Additionally, the locks can also be made tamper-proof, as a lock L1 of FIG. 3 reveals. The embodiment of FIG. 3 prevents the blocking pins 7, 8 from being forced far enough toward the outer perimeter 19' of the cylinder 2' by means of a tool or the like so that they align with the perimeter 19' to prevent the entry of the housing pin situated in this plane of the lock into one of the counter-sinks placed in front of the blocking pin bores as the result of such tampering.

According to FIG. 3, the resistance to tampering is achieved by modulating the height of the profile ribs 12, 13. In FIG. 3, the ribs 12, 13 exhibit a sequence of elevations and depressions 121, 131. The blocking pins 7, 8 sense the elevations (normal profile rib height) 12, 13. As viewed from the key bit, safety pins 28, 29 are placed in front of the pins 7, 8. The safety pins 28, 29 which sense the depressions 121, 131 are seated in cylinder core bores 30, 31 which are located opposite bores 32, 33 in the housing 1'. Any attempt to align the blocking pins 7, 8 due to simulation of the profile ribs 12, 13 will drive the safety pins 28, 29 laterally into the borings 32, 33 and lock the cylinder 2' from rotating in the housing 1'. This result can be avoided only if the depressions 121 and 131 are properly located adjacent the projections 12, 13.

It is proposed to provide the tamper-proof lock, exhibiting keys which are secured against duplication to the highest degree, with a significantly higher locking security and range of variation than was the case up to now in that at least two additional discontinuous longitudinal ribs provided on at least one lateral side of the key. These additional discontinuous longitudinal ribs cooperate with blocking elements which are preceded, as viewed from the key bit, by safety pins which sense the recesses or interruptions of the additional profile ribs.

Figure 4:
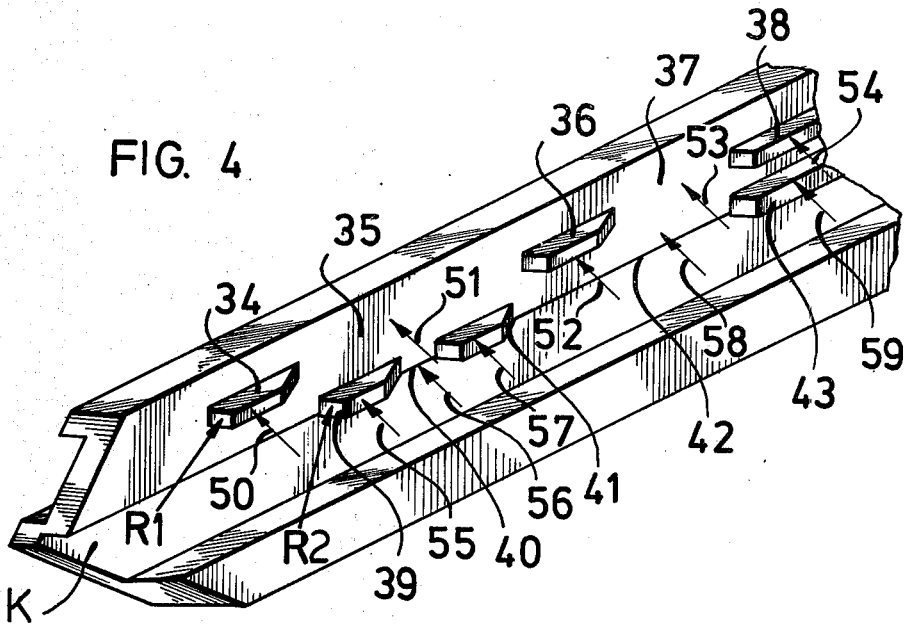
FIG. 4 is a perspective view of a fragment of a master key according to the present invention.

A correspondingly equipped key K is illustrated in FIG. 4. On the flat side visible in the drawing, are two discontinuous profile ribs R1, R2 which are split up into rib pieces or, segments by depressions or interruptions. Rib R1 includes elements 34, 36 and 38 which are separated by depressions 35 and 37. Rib R2 includes elements 39, 41, 43 which are separated by depressions 40 and 42. The rib members or segments 34, 36, 38, 39, 41 and 43 are sensed by blocking pins shown as arrows 50, 52, 54, 55, 57 and 59, which completely correspond to the blocking pins 7, 8, 21 and 22 of FIGS. 1 through 3. The depressions 35, 37, 40 and 42 are sensed by safety pins which are indicated by means of arrows 51, 53, 56 and 58. If the key K has the same structure on its other flat side and if one assumes five coordination notches with corresponding tumblers at the narrow side of the key, then one obtains 25 sensing locations per lock. This number of sensing locations provides an increased resistance to duplication of the keys, particularly of the higher order keys, as well as resistance to tampering with the locks in a lock system based on these locks.

Figure 5:
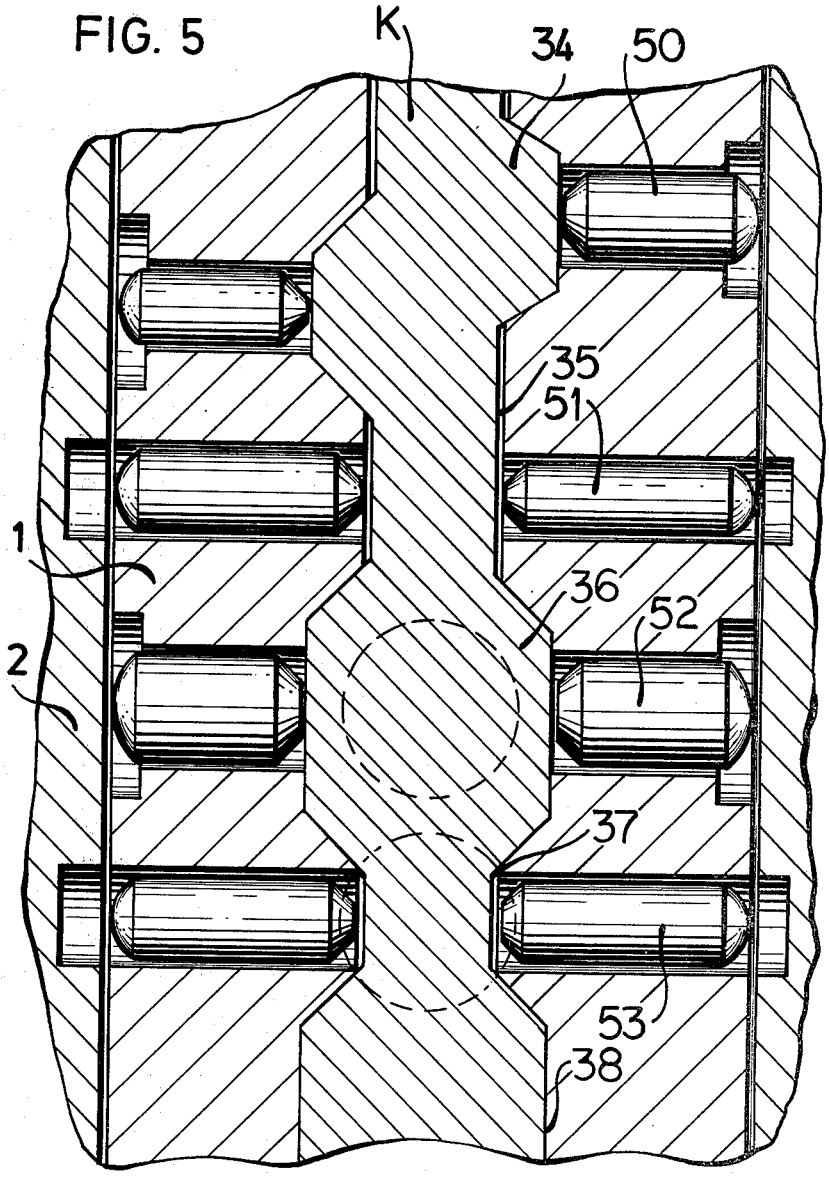
FIG. 5 is a top, fragmentary planar view showing the key of FIG. 4 inserted into a corresponding lock with two sets of blocking pins and two sets of safety pins all of which are unlocked.

FIG. 5, a top view of the key K, shows the arrangement of the profile rib members 34, 36 and 38 and interruptions 35, 37 on the key as well as the sensing elements 50–53 engaging thereon.

It follows from the structure of the lock system described herein that the higher order keys must exhibit a greater plurality of discontinuous profile ribs than the lower order keys and that the main or master key is equipped with the greatest or, respectively, greatest possible plurality of profile ribs.

While various modifications or changes might be suggested by those skilled in the art, it will be understood that we wish to include within the claims of the patent warranted hereon all such modifications and changes as reasonably come within our contribution to the art.

I claim as my invention:

1. In a key for use in a hierarchal lock system with an elongated body having selectively spaced notches cut on an elongated edge thereof, an improvement comprising:

a first plurality of discontinuous rib members selectively arranged and affixed to a side of the body wherein higher order keys in the hierarchy have more discontinuous rib members than do lower order keys.

2. The key according to claim 1 including:

a second plurality of discontinuous rib members selectively arranged and affixed to an opposite side of the body.

3. In a lock system having a hierarchy of higher order and lower order keys wherein each key has an elongated body, an improvement comprising:

a plurality of discontinuous rib members selectively attached to the body of each key wherein the higher order keys in the hierarchy have more discontinuous rib members than do the lower order keys.

4. In a key for use in a hierarchal lock system with an elongated body portion, an improvement comprising:

first and second discontinuous longitudinal ribs attached to a side of the body wherein higher order keys in the hierarchy have more discontinuous rib members than do lower order keys.

5. The improved key according to claim 4, including additionally:

third and fourth discontinuous longitudinal ribs attached to another side of the body.

6. In a key for use in a hierarchal lock system wherein each lock has a housing with a rotary cylinder mounted within the housing, spring biased radially oriented locking pins and safety pins positioned within the rotary cylinder, the key has an elongated body having selectively spaced notches cut on an elongated edge thereof, an improvement comprising:

a first plurality of discontinuous rib members selectively arranged and affixed to a side of the body of the key, said rib members are adapted to engage selected safety pins in a lock into which said key is to be inserted to permit said lock to be unlocked provided said notches in said elongated edge simultaneously displace the spring biased locking pins in the lock a selected amount and wherein at least some of said notches, in a lower order key, are deeper than in a higher order key.

7. The key according to claim 6 having further:

a second plurality of discontinuous rib members selectively arranged and affixed to a second side of the body of the key and wherein higher order keys in the hierarchy have more discontinuous rib members than do lower order keys.

8. The key according to claim 7 including further:

third and fourth pluralities of discontinuous rib members, said third plurality of discontinuous rib members is selectively arranged and affixed to said side of the key, and said fourth plurality of rib members is selectively arranged and affixed to said second side of the key.

9. A plurality of keys for use in a hierarchal lock system wherein each member of said plurality of keys has:

a rigid elongated body portion adapted to be inserted into a lock to be unlocked, a first plurality of discontinuous rib members selectively arranged along a first side of said body, a second plurality of distontinuous rib members selectively arranged along a second side of said body, and one or more notches cut into an edge of said body, and wherein, selected ones of said notches are cut deeper into those of said keys adapted to open fewer of the locks, thereby removing adjacent portions of members of said first or second plurality of rib members, than corresponding notches are cut in those of said keys adapted to open more of the locks.

* * * * *